United States Patent [19]

Chomyn

[11] Patent Number: 5,075,823

[45] Date of Patent: Dec. 24, 1991

[54] COLOR CORRECTING SYSTEM FOR FLUORESCENT LIGHTING

[75] Inventor: Kenneth G. Chomyn, Saskatoon, Canada

[73] Assignee: Video One Systems Ltd., Saskatoon, Canada

[21] Appl. No.: 614,396

[22] Filed: Nov. 16, 1990

[51] Int. Cl.[5] ..... F21V 9/02

[52] U.S. Cl. ..... 362/2; 362/255; 362/293

[58] Field of Search ..... 362/2, 255, 293, 260

[56] References Cited

U.S. PATENT DOCUMENTS

| | | | |
|---|---|---|---|
| 3,112,886 | 12/1963 | Kushner | 362/2 |
| 3,757,101 | 9/1973 | Semotan | 362/2 |
| 3,757,103 | 9/1973 | Walter | 362/2 |

*Primary Examiner*—Stephen F. Husar

*Attorney, Agent, or Firm*—Murray E. Thrift; Stanley G. Ade; Adrian D. Battison

[57] ABSTRACT

Room light, especially fluorescent lighting is corrected to provide a green-magenta balance comparable to that of natural sunlight by measuring the green-magenta balance of the lighting within the room and applying a filter to each light source to bring the balance to the desired level. This ameliorates the detrimental physiological effects of an unnatural light spectrum in a workspace.

6 Claims, 2 Drawing Sheets

COLOR CORRECTING SYSTEM FOR FLUORESCENT LIGHTING

FIELD OF THE INVENTION

The present invention relates to room illumination and more particularly to controlling the spectral output from artificial lighting, especially fluorescent lighting.

BACKGROUND

In some work environments, the lighting has been found to create physiological problems for persons exposed to the lighting over lengthy periods. This has led to the development of improved light sources that purport provide a more natural light spectrum or "softer" light. Fluorescent tubes having these characteristics are quite expensive and have not been found to provide fully satisfactory results The present invention is concerned with a novel method and system for correcting the lighting in a room to provide an improved, more comfortable lighting condition.

SUMMARY

According to one aspect of the present invention there is provided a method varying the light spectrum in a room lit by artificial light sources, said method comprising applying to each source of light a colour compensating filter sufficient to adjust the green-magenta balance of the light emitted thereby to a predetermined balance.

The predetermined green-magenta balance will normally be that of natural sunlight. According to another aspect of the present invention there is provided a system for controlling the light spectrum in a room lit by artificial light sources comprising means for measuring the green-magenta balance of the light spectrum in the room and plural filter means operable to adjust the green-magenta balance of the light by different amounts.

Actual field trials with the system have proven highly successful. Reduced headaches, reduced work stress and a reduced requirement for personnel "break time" have all been observed.

Filters of the type employed in the present method and system have been used in the past for light control in motion pictures, still photography and television production. The filters are used in those environments to balance various light sources with different spectral outputs, so that there is consistent light throughout a scene as perceived by the camera. Once consistency has been achieved, corrections can be made in the laboratory, using a lens filter or with the video white balance.

In the present invention, the system is used to provide a complete room light balance to a predetermined standard that is comfortable for normal human eyesight.

The filters may be applied by laying a sheet of filter material into the lens of a lamp to be balanced. Alternatively, the filter may be made into a tube to fit over a fluorescent light tube.

BRIEF DESCRIPTION OF THE DRAWINGS

In the accompanying drawings which illustrate exemplary embodiments of the present invention.

DETAILED DESCRIPTION

Figure 1:
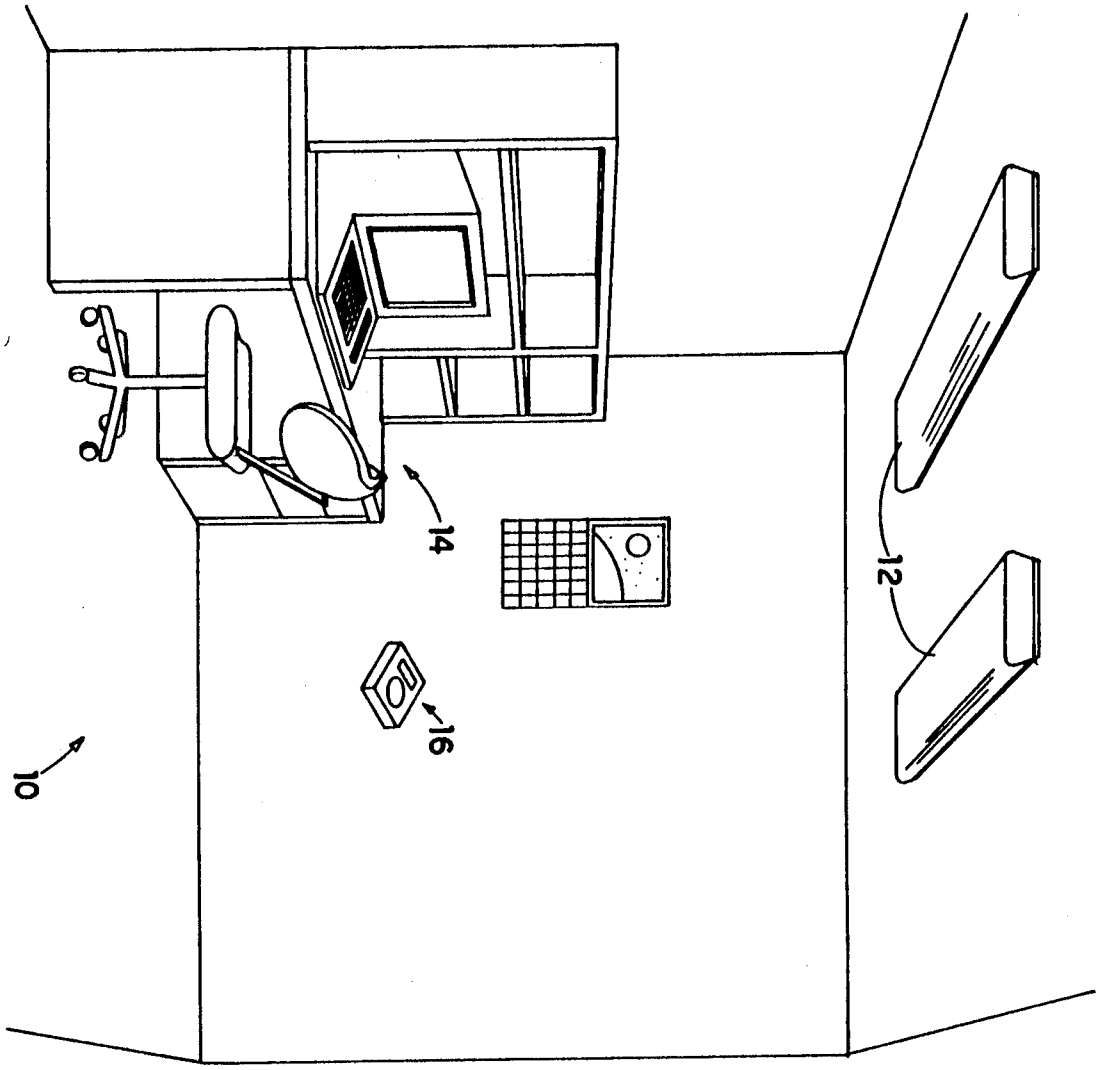
FIG. 1 is a schematic representation of the present system as used in a work space.

Referring to the accompanying drawings, FIG. 1 illustrates a work space or room 10 illuminated by fluorescent lamps 12. The room is illustrated as containing a work station 14. Under conventional conditions, the illumination in a room lit in this way will be excessively green in its content. This is ascertained using a meter 16 that preferably provides a direct output showing the correction required to meet a predetermined balance. Each light source is measured to determine the required correction. Once the required correction has been determined, an appropriate filter is selected such as a "CINEGEL TM" filter of the type sold by Rosco Laboratories, Limited of 1271 Dennison Street, No. 66, Markham, Ontario, Canada L3R 4B5 and is applied to each of the light sources and the corrected balance verified.

Figure 2:
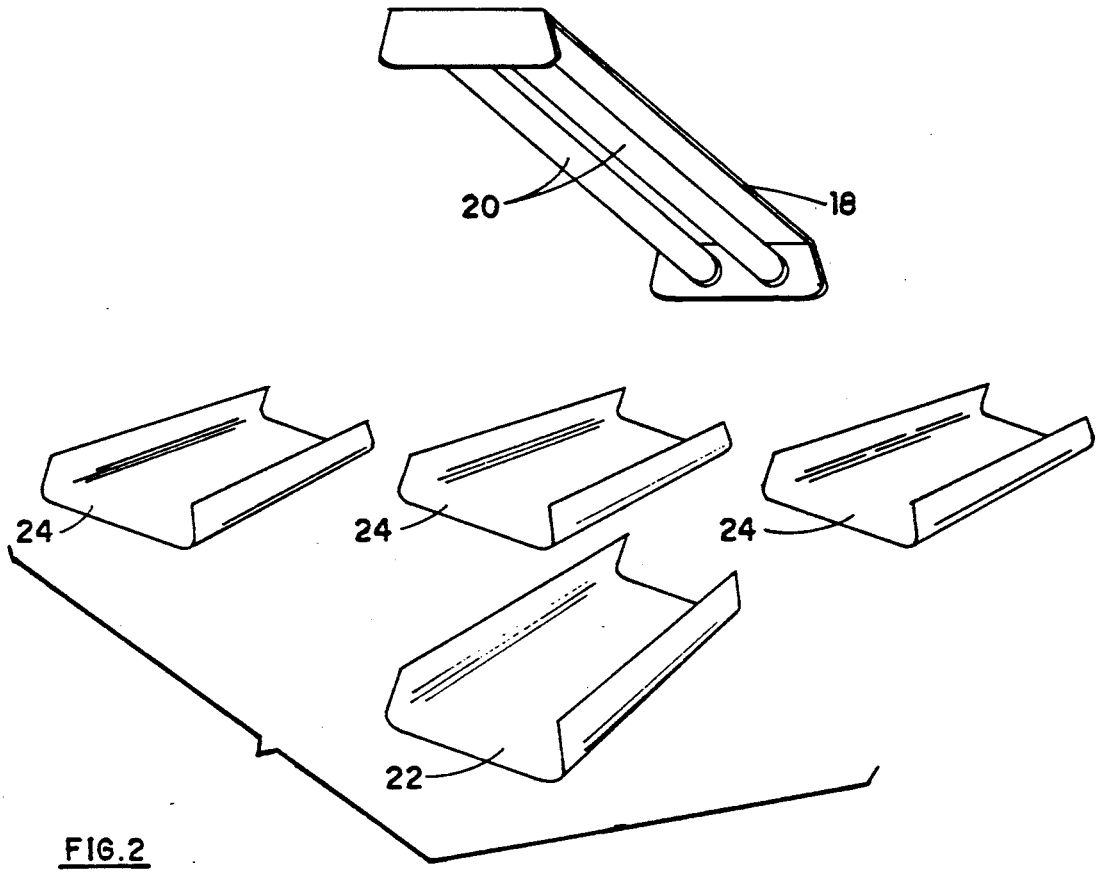
FIG. 2 is an isometric view showing application of the filter medium to a lamp lens.

The filter may be applied as illustrated in FIG. 2 where a light fitting 18 carries a fluorescent tube 20 and a lens 22 that is illustrated separated from the fitting. The fitting is equipped with a selected one of the filters 24 by laying the filter as a sheet into the lens 22 and then replacing the lens on the fitting 18.

Figure 3:
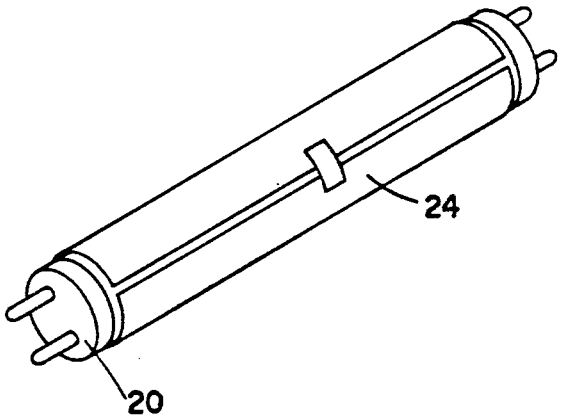
FIG. 3 is an isometric representation showing application of the filter medium as a tube to a fluorescent lamp tube.

FIG. 3 illustrates an alternative method of applying a filter to a fluorescent light tube. In this case, the filter medium is itself formed into a tube and applied to the fluorescent tube, by sliding it on from the end. Alternatively, the sheet material may be rolled onto the fluorescent tube and held in place with an adhesive tape.

While certain embodiments of the present invention have been described in the foregoing, it is to be understood that other embodiments are possible within the scope of the invention and are intended to be included within the appended claims.

I claim:

1. A method of varying the light spectrum in a room lit by light fittings having artificial light sources and removable lenses, said method comprising measuring the green-magenta balance of the light emitted by each light fitting, selecting a filter sheet for each fitting for adjusting the green-magenta balance of the light emitted by the fitting to a balance closer to a predetermined balance, removing the lens from the light fitting, laying the filter sheet into the lens of the light fitting to filter light passing through the lens and replacing the lens in the fitting.

2. A method according to claim 1 wherein the light sources are fluorescent light sources.

3. A method of varying the light spectrum in a room lit by light fittings having linear fluorescent tubes as artificial light sources, said method comprising measuring the green-magenta balance of the light emitted by each fitting, selecting a filter sheet for each fitting for adjusting the green-magenta balance to a balance closer to a predetermined balance and forming the filter sheets into tubes around the respective fluorescent tubes.

4. A system for controlling the light spectrum in a room lit by an artificial light source comprising means for measuring the green-magenta balance of the light spectrum in the room and a plurality of filter means individually applicable to the light source, each filter means comprising means for altering the green-magenta balance of the light spectrum by an amount different from the other filter means whereby one of the filter means may be selected for application to the light source to provide a light spectrum with a desired green-magenta balance.

5. A system according to claim 4 wherein the light source is a fluorescent source.

6. A system according to claim 4 wherein each filter means comprises a sheet material.

* * * * *